United States Patent [19]

Nishiguchi et al.

[11] Patent Number: 4,499,859

[45] Date of Patent: Feb. 19, 1985

[54] VAPOR GENERATOR

[75] Inventors: Akira Nishiguchi; Sanpei Usui; Tomihisa Oouchi, all of Ibaraki; Kazumi Iwai, Mito, all of Japan

[73] Assignee: Hitachi, Ltd., Tokyo, Japan

[21] Appl. No.: 495,584

[22] Filed: May 18, 1983

[30] Foreign Application Priority Data

May 21, 1982 [JP] Japan ..... 57/84740

[51] Int. Cl.[3] ..... F22B 5/02

[52] U.S. Cl. ..... 122/18; 122/14; 122/367 C

[58] Field of Search ..... 122/14, 18, 19, 367 C; 126/361

[56] References Cited

U.S. PATENT DOCUMENTS

| | | | |
|---|---|---|---|
| 2,159,571 | 5/1939 | Stack | 122/367 C |
| 3,934,554 | 1/1976 | Carlson | 122/367 C |
| 4,344,386 | 8/1982 | Black | 122/18 X |
| 4,356,794 | 11/1982 | Bouman et al. | 122/14 X |

*Primary Examiner*—Edward G. Favors

*Attorney, Agent, or Firm*—Antonelli, Terry & Wands

[57] ABSTRACT

A vapor generator for use in, for example, an absorption type water cooler or heater. The vapor generator having a burner section and a boiler section, the boiler section being constituted by an outer casing, an inner casing disposed in the outer casing, and a multiplicity of solution tubes attached in rows to the inner surfaces of wall of the inner casing so as to extend substantially vertically. The interior of the tubes is in communication with a space accommodating a medium to be heated and defined between the inner casing and outer casing. A multiplicity of fins are attached to the inner surfaces of walls of the inner casing in the area around the flame formed by the burner section so as to increase the rate of heat transfer to the medium in the above-mentioned space from the gas in the combustion chamber. The axis of each of the solution tubes in a second row is offset from the line which extends in parallel with the flow of gas from the midst of the gap between two adjacent solution pipes in a first row located upstream from the second row as viewed in the direction of flow of gas, so that overheating of the central portion of each solution tube in the second row is avoided advantageously.

14 Claims, 5 Drawing Figures

VAPOR GENERATOR

BACKGROUND OF THE INVENTION

Field of the Invention

The present invention relates to a vapor generator and, more particularly, to a vapor generator for use in a cooler or heater of absorption type or to a steam generator which generates steam for air conditioning purpose.

A vapor generator generally referred to as "flue tube type generator", having burners, flue and tubes, has been known as a typical example of the vapor generators of the kind mentioned above.

In this type of vapor generator, the flame formed by burning of a fuel atomized from burners, as well as the gas of high temperature produced as a result of burning, passes through the flue to heat and evaporate a medium which is stored in a drum around the flue and also in the tubes.

In a conventional flue tube type vapor generator, a plurality of vertically extending tubes are arranged in rows such that tubes of one row are staggered from those of adjacent rows when viewed in plan. In other words, each tube of second row appears through the gap between each pair of adjacent tubes of first row, when viewed in the direction of flow of the gas. One problem of such an arrangement of the tubes resides in the fact that the tubes of the first row restrict the area of passage for the gas. As a result, the flow velocity of the gas is through the restricted passages formed between respective two adjacent tubes of the first row is increased, and the gas of increased velocity is directed to the center of each tube of the second row due to a nozzle action performed by each restricted flow passage. Consequently, the tubes of the second row are locally overheated at their central portions to cause a rapid local corrosion at such central portions. Another problem encountered by this conventional flue tube type resides in the fact that the exchange of heat between the medium in the drum around the flue and the flame and high-temperature gas around the flame is made only across the smooth wall defining the flue, so that heat is exchanged only at a small rate between the gas around the flame and the medium in the drum. Consequently, the gas contacts the tubes of the first row while it is still hot, i.e. before making substantial temperature drop. Thus the tubes of the first row are also overheated locally to exhibit rapid corrosion. This problem will be overcome if there is an ample distance between the flame and the tubes of the first row. Such arrangement, however, will increase the overall size of the vapor generator.

SUMMARY OF THE INVENTION

Accordingly, an object of the invention is to provide a vapor generator improved to eliminate local heating of tubes.

Another object of the invention is to prolong the life of vapor generator by eliminating local overheat.

Still another object of the invention is to provide a vapor generator having a reduced size.

According to the invention, the walls defining the flue is provided at portions thereof around the flame with fins so that the heat is delivered at a greater rate to the medium in the drum around the flue than in the conventional vapor generator through the fins and the walls defining the flue. Consequently, the temperature of the gas entering the region of the first row of the tubes is lowered to such a level so as to eliminate local overheating of the tubes.

In accordance with another feature of the invention, the axis of each tube in the second row is disposed at a deviation in the direction perpendicular to the direction of flow of the gas from the gap between two adjacent tubes in the first row. More specifically, an offset a of the axes of tubes in the second row from the center axis of the gap between two adjacent tubes in the first row is determined to satisfy the condition of $S/2<a<(D-S)/2$, where, D represents the outside diameter of the tubes in the second row and S represents the space between two adjacent tubes in the first row, on condition that the relationship expressed by $D>2S$ is met.

In accordance with a further feature of the invention, the tubes of the first row have an outside diameter greater than the diameter or diameters of the tubes in the second and subsequent rows of tubes, so as to suppress the tendency of local superheating of tubes in the first row. Namely, the rate of heat transfer from the gas to the tube is in inverse proportion to the root of the radius of curvature of the foremost end of the tube. The greater outside diameter, i.e. the greater radius of curvature of the tube surface, reduces the rate of heat transfer from the gas to the tubes in the first row so that the temperature of the tubes in the first row is effectively lowered even when the gas temperature is high. This effectively contributes to the elimination of overheating of the tubes in the first row.

It is to be understood, however, the invention can have other features which will become clear from the following description of the preferred embodiments taken in conjunction with the accompanying drawings.

DETAILED DESCRIPTION

Figure 1:
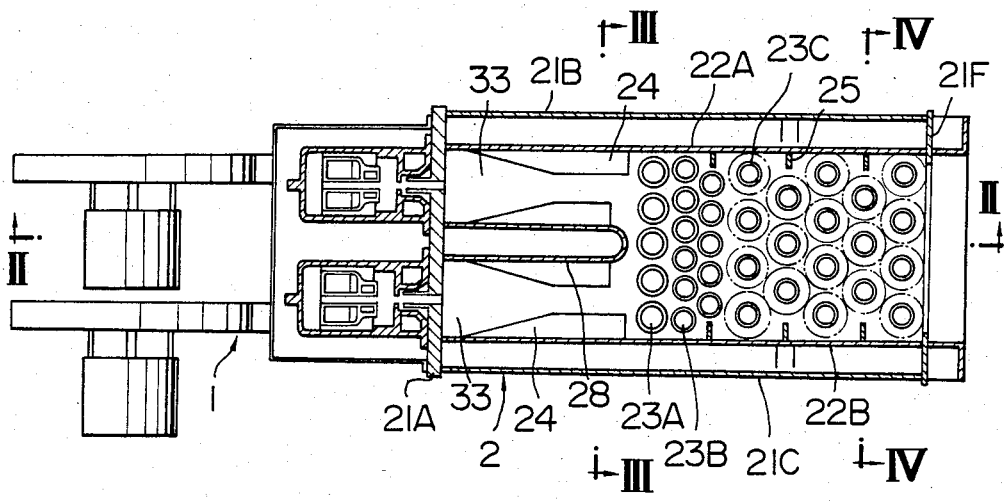
FIG. 1 is a plan view of a typical embodiment of a constructed in accordance with the invention.
Figure 2:
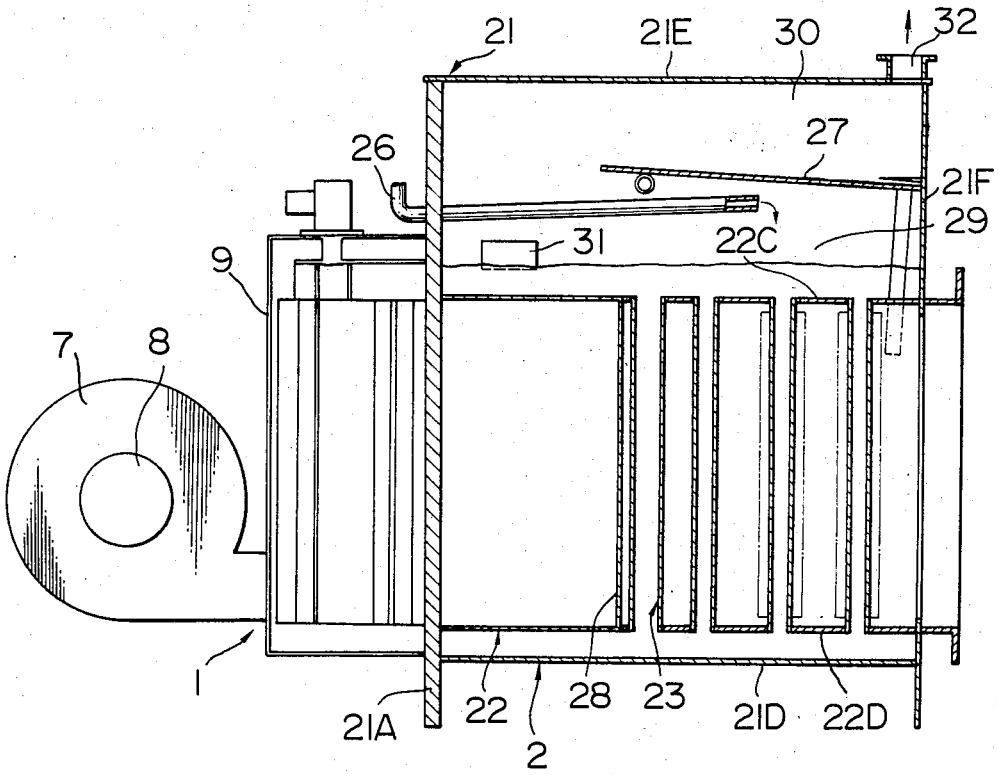
FIG. 2 is a cross sectional view taken along the line II-II in FIG. 1.
Figure 5:
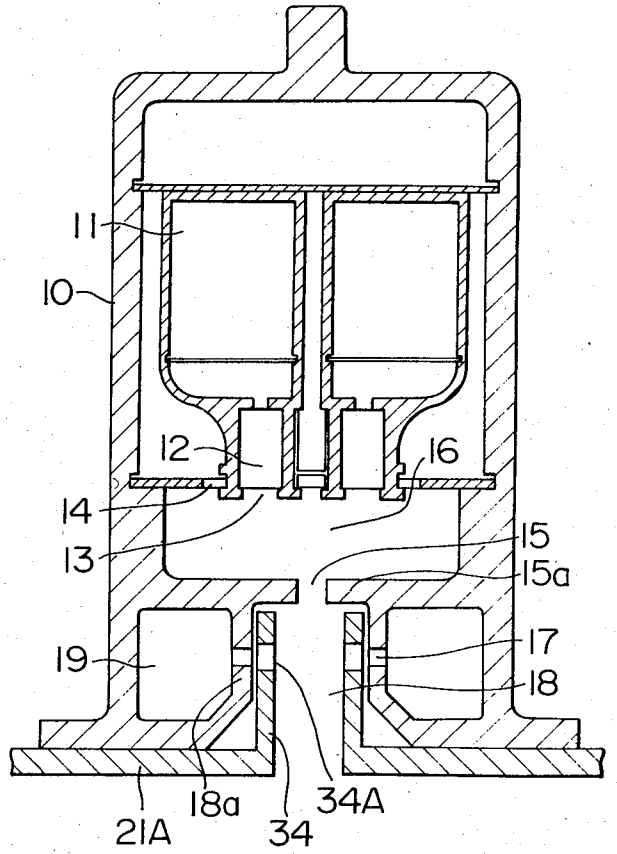
FIG. 5 is a plan view of a burner.
Figure 4:
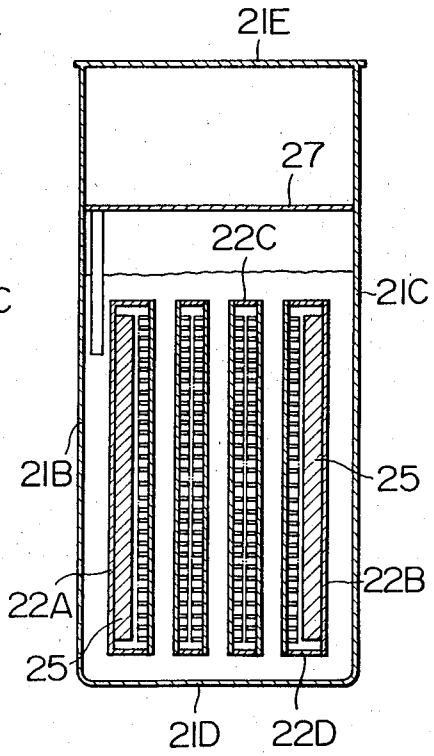
FIG. 4 is a cross sectional view taken along the line IV-IV in FIG. 1.
Figure 3:
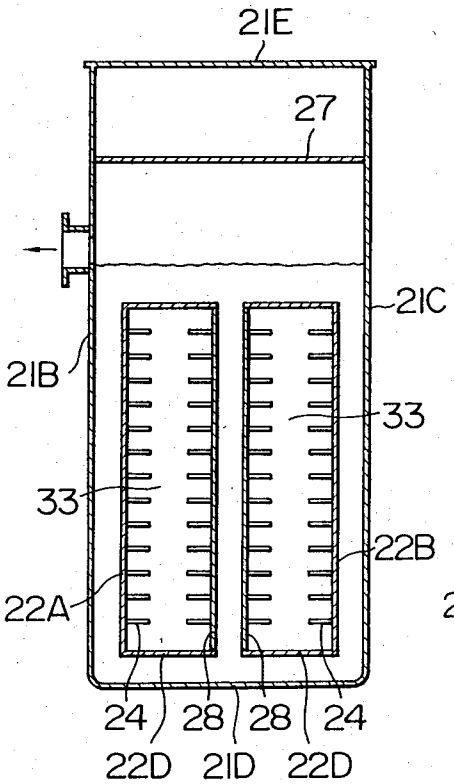
FIG. 3 is a cross sectional view taken along the line III-III in FIG. 1.

Referring now to the drawings wherein like reference numerals are used throughout the various views to designate like parts and, more particularly, to FIGS. 1 and 5, according to these figures, a generator, incorporated in an absorption type heater includes a burner section generally designated by the reference numeral 1 including burners comprising a premixing chamber 11 in which a gasified liquid fuel or a gaseous fuel is premixed with primary air; linear ports 12; linear flame ports 13; passages 14 for introducing secondary air to the area around the flame ports 13; a restriction **15*a* for defining a restricted linear passage 15 opposing to the flame ports 13; primary combustion chamber 16; a scondary combustion chamber 18 having nozzle ports 17 for jetting tertiary air to the area downstream from the restriction 15 from both sides of the flame; a tertiary air chamber 19** and so forth. A burner of the type described in, for example, commonly assigned United States Application Ser. No. 381,304.

The generator also includes a boiler section generally designed by the reference number 2 having a rectangular parallelepiped outer casing 21, an inner casing 22 which also has a parallelepiped rectangular form, a plurality of solution pipes 23 attached to the inner casing 22, a large number of fins 24 attached to the inner casing 22, passage adjusting plates 25 for preventing bypassing of the gas and maintaining a substantially constant area of flow passage, solution supply pipe 26, baffle plate 27 for separating liquid fraction of droplets from the vapor and a partition wall 28.

The outer casing 21 has an end plate 21A thicker than other walls of the outer casing 21, namely, two side walls 21B and 21C, welded to the end plate 21A, a bottom wall 21D, a top wall 21E and a second end wall 21F, welded to the ends of the side walls 21B, 21C, bottom wall 21D and the top wall 21E. Both side walls 21B and 21C and the bottom wall 21D are formed integrally by bending a flat sheet material into a substantially U-shaped configuration, although these walls may be formed separately and welded together. The inner casing 22 is composed of two side walls 22A and 22B, a top wall 22C and a bottom wall 22D which are welded together into the rectangular parallelepiped form. The inner casing 22 is welded at its one end to the end plate 21A of the outer casing 21 and at its other end to the second end plate 21F of the outer casing 21, so that a space 29 for accomodating a medium to be heated and a space 30 for separating vapor from liquid droplets are formed between the outer casing 21 and the inner casing 22. The partition wall 28 has a U-shaped horizontal section and is welded at both ends of legs of the U-shape to the end plate 21A while the upper and lower ends are welded to the top wall 22C and bottom wall 22D.

A plurality of fins 24 are secured to both side walls 22A, 22B of the inner casing 22, as well as to the partition wall 28. The height of the fins 24 from the wall surface is gradually increased towards a longitudinal mid portion but is held constant in the region beyond the longitudinal mid portion.

Three solution pipes 23 are connected at their upper and lower end to the top wall 22C and bottom wall 22D of the inner casing 22. The interior of the solution pipes 23 are communicated with the space 29. The solution tubes 23A of the first row have an outside diameter D which is greater than the diameter or diameters of the tubes in the second and following rows. Thus, the solution tubes 23B in the second and third rows have an outside diameter smaller than that D of the solution tubes 23A in the first row. The axis of each solution tube 23B in the second row is offset from the gap between two adjacent solution tubes 23B in the second row. More specifically, the positions of the solution tubes 23B in the second row are determined to meet the condition of: $S/2<a<(D-S)/2$, where, D represents the outside diameter of the solution tubes 23A in the first row, S represents the distance or gap between two adjacent solution tubes 23A in the first row and a represents the distance between the center axis of the gap between two adjacent solution tubes 23A in the first row and the axis of the solution tube 23B in the second row. The solution tubes 23B in the third row are arranged such that the axis of each of these tubes laps the gap between two adjacent solution tubes 23B in the second row. In other words, the solution tubes in the second and third rows are arranged in a staggered manner.

Solution tubes 23C in the fourth to eighth rows, each having circular fins on the outer peripheral surface thereof, are arranged in a staggered form. Although in the illustrated embodiment the finned solution tubes 23C are arranged in five rows, any suitable number of such rows not less than three is selected in accordance with the capacity of the boiler, i.e. the desired rate of evaporation, or the total heat transfer rate. The flow passage adjusting plates 25 are attached to the inner surfaces of both side walls 22A and 22B of the inner casing 22 to extend vertically therealong, in alignment with the solution tubes 23B, 23C in the third, fifth and seventh rows. In other words, the flow passage adjusting plates 25 are disposed at such positions where the distance or gap between the inner surfaces of side walls 22A, 22B and the outermost solution tubes 22B, 22C is large, so as to prevent by-passing of the gas through the gap between the solution tubes 23B, 23C and the inner surfaces of the side walls 22A, 22B of the inner casing 22. The medium supply pipe 26 for supplying the medium to be heated has an opening positioned substantially at lengthwise mid point in the space 29. In the illustrated embodiment, the medium to be heated is supplied from an absorber into the space 29 through the supply pipe 26. A medium outlet 31 and a vapor outlet 32 are respectively formed in the side wall 21B and the top wall 21E of the outer casing 21. The outlet 31 is connected to the absorber, while the outlet 32 is connected to the condenser, respectively. As to the operation of the absorption type water cooler or heater, reference is made to the specification of U.S. Pat. No. 3,287,928 and Japanese Pat. No. 647,515.

The burner section 1 is fixed to the end plate 21A of the outer casing 21, to which is secured a heat shielding plate 34 projecting into the secondary combustion chamber 18 of the burner section 1. The heat shielding plate 34 a provided, at its portion thereof confronting the tertiary air outlet 17, with a tertiary air passage 34A. The heat shielding plate 34 may be integral with the end plate 21A or may be separate therefrom.

In operation, the to burners in the burner section 1 are started so as to form flame within the combustion chamber 33 of the inner casing 22. The flame and the resultant combustion gas flow through the inner casing 22 while delivering heat to the medium to be heated through the fins 24, walls 22A, 22B, 22C and 22D of the inner casing 22 and the solution tubes 23 to thereby generate vapor of the solution. Any liquid phase or droplets in the vapor is separated from the vapor as the latter comes into contact with the baffle plate 27 as it flows across the space 30, and the vapor, having almost no liquid phase, is forwarded to the condenser. On the other hand, the medium rich in liquid phase is introduced through the supply pipe 26 into the space 29 where the liquid phase is evaporated to become vapor by the heat given by the gas. The medium, now having only small liquid content, is introduced to the absorber through the outlet 31.

According to the invention, the local overheating of the solution tubes 23A and 23B in the first and second rows is avoided for the following reasons.

In the described embodiment, the height of the fins 24 is so selected in view of the shape of the flame formed by the burner section 1 that the fins 24 are not directly contacted by the flame. It is, therefore, possible to effectively transfer the heat from the gas of high temperature around the flame to the medium around the combustion chamber 33 through the fins 24, walls 22A, 22B, 22C and 22D of the inner casing 22 and the partition wall 28 by, for example, convection, while avoiding substantial overheating of the fins 24 and suppressing the generation of CO.

According to the invention, it is possible to increase the rate of heat transfer, i.e. the heat flux, to the medium around the combustion chamber 33. Consequently, the temperature of the combustion gas is lowered to such a level so as not to cause any excessive increase of heat flux applied to the solution tubes 23A even when the distance between the solution tubes 23A and the flame is decreased. It is, therefore, possible to reduce the length of the combustion chamber 33.

Additionally, since the solution tubes 23A in the first row having an outside diameter greater than the diameters of the tubes in the following rows, the rate of local heat transfer to the foremost end of the first row is decreased in inverse proportion to the root of the increased radius of curvature of the tube surface. It is to be understood also that, partly because the solution tubes 23B and 23C in the second and following rows have a diameter or diameters different from that of the solution tube in the first row and partly because the axis of each solution tube 23B in the second row is offset from the gap between two adjacent solution tubes 23A in the first row, the flow of gas accelerated while passing through the restricted passage between two adjacent tubes 23A in the first row collides with the portion of each tube 23B in the second row slightly offset from the axis, so that undesirable stagnation of gas and, hence, the local heating of the solution tubes 23B are effectively avoided to ensure uniform distribution of the heat flux.

When the burner section is made of aluminum, the aluminum wall 18*a* of the secondary combustion chamber is heated to a high temperature (about 350° C.) which can not be withstood by aluminum due to the transfer of heat by radiation or convection from the combustion gas of high temperature (1300° to 1500° C.) under reaction within the secondary combustion chamber. The excessive heating of the wall 18*a* of the secondary combustion chamber imposes also a problem of fatigue rupture in the joint between the wall 18 and the end plate of the boiler section due to thermal stress caused by the difference in the thermal expansion coefficient. These problems, however, are effectively overcome in the vapor generator of the invention because of the presence of the heat shielding plate 34 projected into the secondary combustion chamber. Namely, the heat transferred by radiation or convection is relieved to the boiler through the heat shielding plate so that the wall 18*a* of the secondary combustion chamber 18 is not excessively heated thereby avoiding the problems of overheating and thermal fatigue rupture.

A vapor generator was actually constructed in accordance with the invention. The vapor generator had a capacity of 20 ref. tons with two burners each having a heat output of 30000 Kcal/h. It was confirmed that the volume of the vapor generator as a whole can be reduced remarkably, in fact almost to a half, as compared with the conventional vapor generator having the same capacity. In the constructed vapor generator, an easy capacity control was achieved due to the use of two burners. Additionally, the burners where effectively cooled by the combustion air in the combustion air chamber surrounding the burners.

As has been described, according to one preferred form of the invention, aluminum linear burner having a small size and high heat output is used to permit a reduction of size of the combustion chamber. Additionally, undesirable local overheating of the foremost ends of the solution tubes is avoided by the provision of fins on the walls of the combustion chamber and by the offset of the solution tubes in the second row from the center of the gap of two adjacent solution tubes in the first row. Consequently, according to the invention, it is possible to attain a uniform heating of the whole vapor generator and, hence, to increase the mean heat flux, to thereby reduce the size and cost of the generator. Furthermore, the reduced length of the flue, afforded by the provision of fins to the combustion chamber wall, permits a reduction in the amount of medium to be heated held in the vapor generator, which, in turn, makes it possible to reduce the size of the generator and to shorten the time required until the generation of vapor to thereby considerably improve the start-up characteristics of the absorption type water cooler or heater.

Although the invention has been described through specific terms, it is to be noted here that the described embodiment is only illustrative but not exclusive, and various changes and modifications may be imparted thereto without departing from the scope of the invention which is limited solely by the appended claims.

What is claimed is:

1. A vapor generator having a burner section and a boiler section, said boiler section including an outer casing, an inner casing disposed in said outer casing, and a plurality of solution tubes attached in rows to inner surfaces of walls of said inner casing so as to extend substantially vertically, an interior of said tubes being in communication with a space accommodating a medium to be heated and defined between said inner casing and outer casing, a plurality of fins are attached to the inner surfaces of the walls of said inner casing in an area around a flame formed by said burner section, an axis of each of said solution tubes in a second row is offset from a line which extends in parallel with a flow of gas from a center of a gap between two adjacent solution pipes in a first row located upstream from said second row, as viewed in a direction of flow of the gas, a distance between the axis of each solution tube in said second row and the center of the gap between two adjacent solution tubes in said first row is greater than S/2 but not greater than (D−S)/2, where:

S represents the gap between two adjacent solution tubes in said first row, and

D represents an outside diameter of a solution tube in said second row.

2. A vapor generator having a burner section and a boiler section, said boiler section including an outer casing, an inner casing disposed in said outer casing, and a plurality of solution tubes attached in rows to inner surfaces of walls of said inner casing so as to extend substantially vertically, an interior of said tubes being in communication with a space accommodating a medium to be heated and defined between said inner casing and outer casing, a plurality of fins are attached to the inner surfaces of the walls of said inner casing in an area around a flame formed by said burner section, an axis of each of said solution tubes in a second row is offset from a line which extends in parallel with a flow of gas from a center of a gap between two adjacent solution pipes in a first row located upstream from said second row, as viewed in a direction of flow of the gas, an outside diameter of said solution tubes in said first row is greater than an outside diameter of the solution tubes in said second row.

3. A vapor generator according to claim 1, wherein the solution tubes in said first and second rows and in a third row have no fins on peripheral surfaces thereof and wherein the solution tubes of the fourth to last rows are provided on peripheral surfaces thereof with fins.

4. A vapor generator according to claim 1, wherein vertically extending flow passage adjusting plates are attached to the inner surfaces of walls of said inner casing at such positions so as to provide a substantially constant area of passages across the rows of solution tubes.

5. A vapor generator according to claim 1, wherein said burner section includes two burners, and a U-shaped partition wall connected to said inner casing at a position between the flames formed on said two burners.

6. A vapor generator comprising:

an outer casing having a parallelepiped form;

an inner casing received by said outer casing and cooperating with said outer casing in defining therebetween a space for accommodating a medium to be heated;

at least one burner fixed to an end of said outer casing and arranged to form a flame within said inner casing;

a plurality of solution tubes arranged in rows and connected to inner surfaces of walls of said inner casing, an interior of said solution tubes being in communication with said space accommodating the medium;

a plurality of fins attached to the inner surfaces of walls of said inner casing in an area around said flame;

a medium supply pipe opening to said space accommodating said medium; and a medium inlet and outlet formed in the walls of said outer casing;

wherein said solution tubes in a first row have an outside diameter greater than an outside diameter of the solution tubes in a second row downstream from said first row, as viewed in a direction of flow of the gas, and wherein an axis of each solution tube in said second row is offset from a center of a gap between two adjacent solution tubes in said first row by a distance which is greater than S/2 but less than (D−S)/2, where:

S represents the gap between two adjacent solution tubes in said first row, and

D represents the outside diameter of said solution tubes in said second row.

7. A vapor generator according to claim 6, wherein said solution tubes in the first and second rows and in a third row have no fin on their peripheries, while the solution tubes in the fourth to last rows have fins on their outer peripheral surfaces.

8. A vapor generator according to claim 6, wherein said burner section has two burners and a U-shaped partition wall connected to said inner casing at a position between the flames formed on the two burners.

9. A vapor generator according to claim 7, wherein said solution tubes are arranged in eight rows disposed in the direction of flow of the gas, with said solution tubes in the fourth to last rows positioned in a staggered manner.

10. A vapor generator according to claim 6, wherein heights of said fins from the inner surface of the walls of said inner casing are gradually increased in a direction of the flow of gas from the upstream side to a mid position of said fins and maintained constant downstream from the mid position.

11. A vapor generator according to claim 2 wherein the solution tubes in said first and second rows and in a third row have no fins on peripheral surfaces thereof, and wherein the solution tubes of the fourth to last rows are provided on peripheral surfaces thereof with fins.

12. A vapor generator according to claim 2, wherein vertically extending flow passage adjusting plates are attached to the inner surfaces of walls of said inner casing at such positions so as to provide a substantially constant area of passages across the rows of solution tubes.

13. A vapor generator according to claim 2, wherein said burner section includes two burners, and a U-shaped partition wall connected to said inner casing at a position between the flames formed on said two burners.

14. A vapor generator according to claim 1, wherein an outside diameter of said solution tubes in said first row is greater than an outside diameter of the solution tubes in said second row.

* * * * *